US006386072B1

(12) United States Patent
Yuan-Chin et al.

(10) Patent No.: US 6,386,072 B1
(45) Date of Patent: May 14, 2002

(54) RATCHET TOOL

(76) Inventors: Chi Yuan-Chin, 11F-2 No. 43, Chai-I Street, Taichung City (TW); Yang Pei-Chih, 4F, No. 357, Da-Na road Su-Lin, Taipei City (TW)

( * ) Notice: Subject to any disclaimer, the term of this patent is extended or adjusted under 35 U.S.C. 154(b) by 0 days.

(21) Appl. No.: 09/812,387

(22) Filed: Mar. 21, 2001

(51) Int. Cl.[7] ..... B25B 13/46
(52) U.S. Cl. ..... 81/63.2; 192/43.2
(58) Field of Search ..... 81/63, 63.2; 192/43.2

(56) References Cited

U.S. PATENT DOCUMENTS 3,269,496 A * 8/1966 Kilness ..... 192/43.2
6,282,993 B1 * 9/2001 Forman et al. ..... 81/63

* cited by examiner

*Primary Examiner*—James G. Smith
(74) *Attorney, Agent, or Firm*—Charles E. Baxley

(57) ABSTRACT

A ratchet tool includes a ring-shaped head and a ring member is rotatably received in the ring-shaped head and a toothed outer periphery of the ring member is engaged with a pawl which is movably received in a recess in an inner periphery of the ring-shaped head. A protrusion extends from a top of the pawl and is retained in a notch of a plate from which two rods extend. A positioning ring is engaged with the ring-shaped head and has a slot so that the two rods extend through the slot. A lever has a head which has two holes so as to receive the two rods of the plate. The pawl can be shifted to engage with the ring member by pushing the lever. Two curve surfaces are defined in the two ends of the pawl and one of which is engaged with a curve surface defining the curve recess. The number of contact teeth between the ring member and the pawl is increased.

2 Claims, 4 Drawing Sheets

RATCHET TOOL

FIELD OF THE INVENTION

The present invention relates to a ratchet tool having a pawl member with a curve surface which is matched with a recess in the head of the tool so as to provide a strong backup when outputting a large torque.

BACKGROUND OF THE INVENTION

A conventional ratchet tool is shown in FIG. 1 and generally includes a head 1 with a ring member 2 rotatably received in a space 10 of the head 1. A toothed outer periphery 20 of the ring member 2 is engaged with a pawl member 3 which has a protrusion biased by a ball 13 urged by a spring 12. The pawl 3 has two tip ends and each of which has two teeth 30 for engaging with the toothed outer periphery 20 of the ring member 2. A lever 35 is connected to the pawl 3 to choose which tip end is engaged with the ring member 2. However, only two teeth 30 engaged with the toothed periphery 20 of the ring member 2 cannot provide enough backup for the ratchet mechanism. In other words, the engagement between the two teeth 30 and the ring member 2 cannot output a large torque and this restrains the use of the ratchet tool.

SUMMARY OF THE INVENTION

In accordance with one aspect of the present invention, there is provided a ratchet tool and comprising a ring-shaped head having a recess defined in an inner periphery thereof. A first passage is defined in a curve surface defining the recess so as to receive a first ball and a first spring. A ring member is rotatably received in the ring-shaped head and has a toothed outer periphery and a serrated inner periphery. A pawl is movably received in the recess and has a toothed surface. A protrusion extends from a top of the pawl. A plate has a notch for retaining the protrusion therein and two rods extend from the plate. A positioning ring is engaged with the ring-shaped head and has a slot through which the two rods extend. A lever has a head which has two holes so as to receive the two rods of the plate.

The primary object of the present invention is to provide a ratchet tool that has a larger contact area between the pawl member and the ring member.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
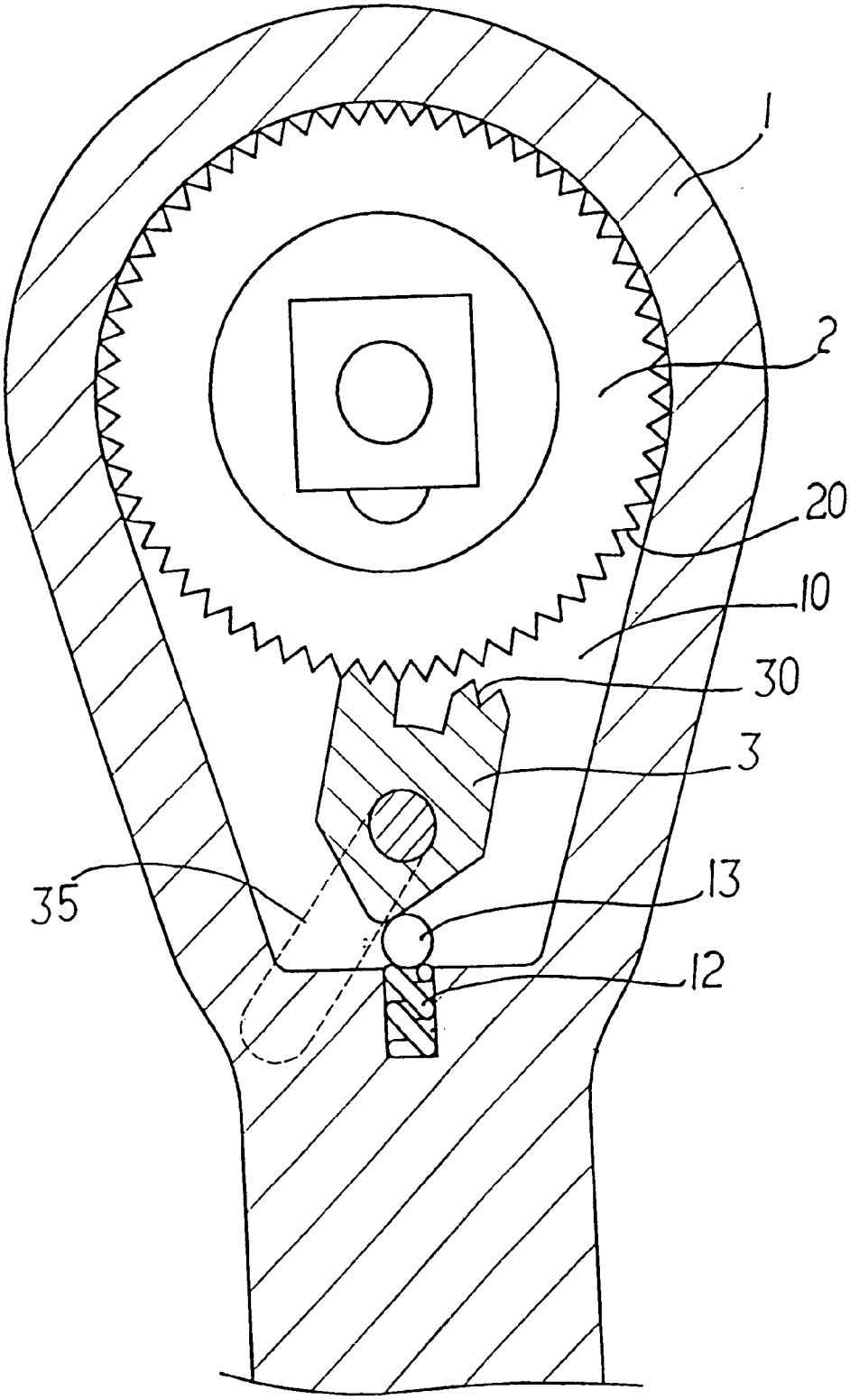
FIG.1 PRIOR ART
FIG. 1 is a cross sectional view to show a conventional ratchet tool.
Figure 2:
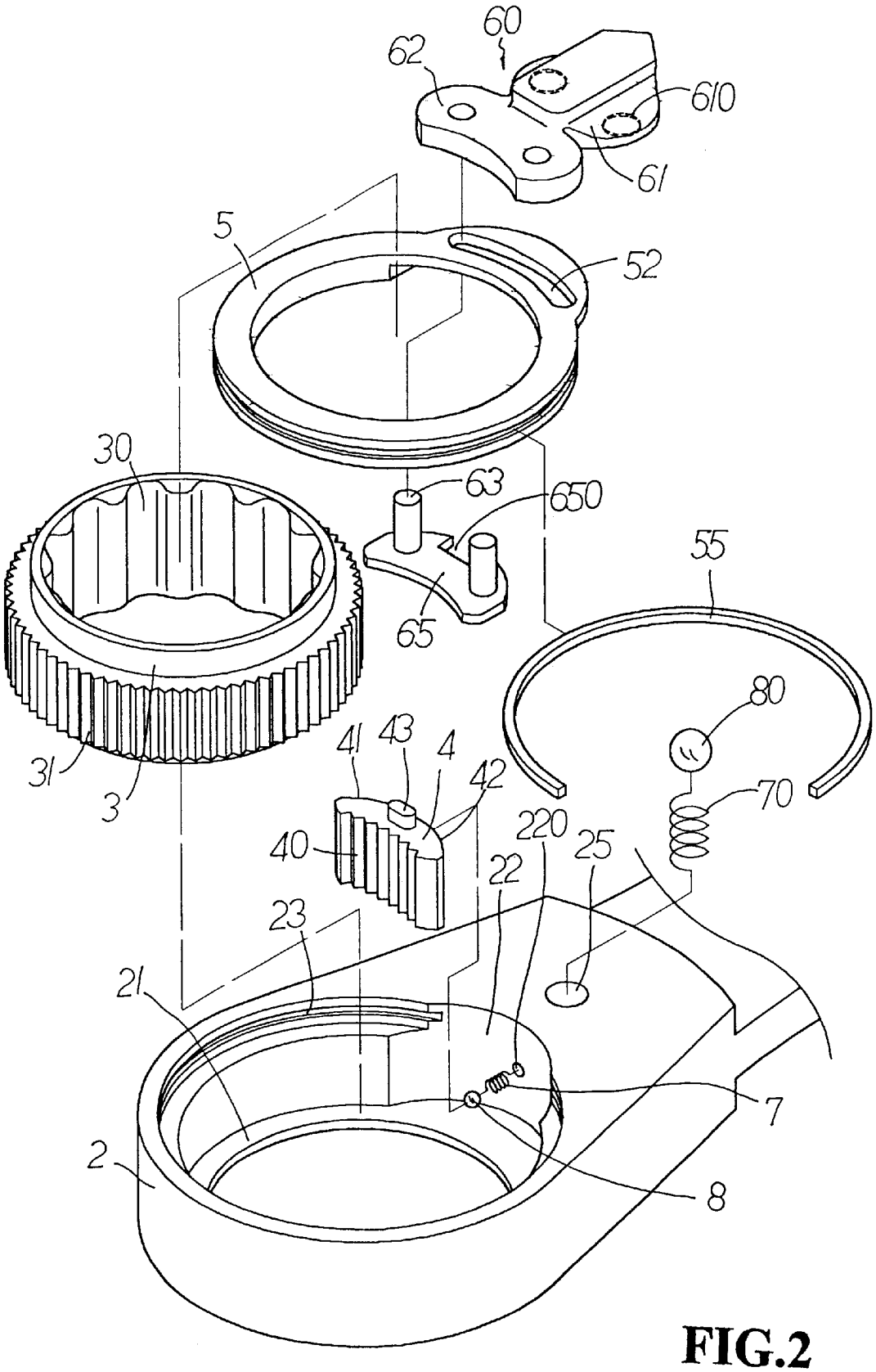
FIG. 2 is an exploded view to show a ratchet tool of the present invention.
Figure 3:
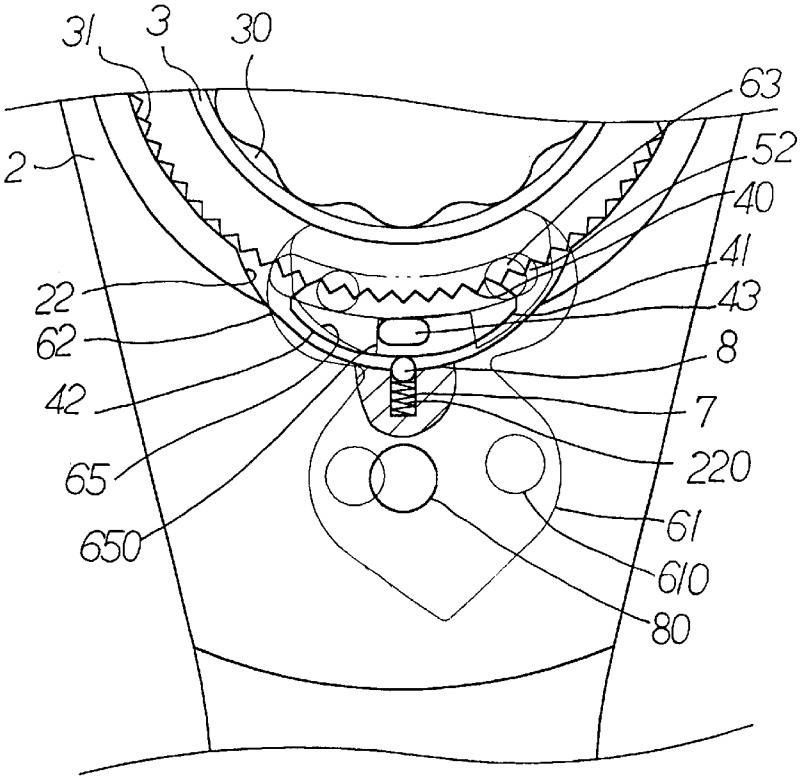
FIG. 3 is an illustrative view to show a lever is about to shifted counter clockwise.

Referring to FIGS. 2 and 3, the ratchet tool of the present invention comprises a ring-shaped head 2 having a recess 22 defined in an inner periphery thereof and a first passage 220 is defined in a curve surface defining the recess 22. A first ball 8 and a first spring 7 are respectively received in the first passage 220, wherein the first ball 8 is pushed by the first spring 7. A second passage 25 is defined in a surface of the ring-shaped head 2 and a second ball 80 and a second spring 70 are received in the second passage 25, wherein the second ball 80 is urged by the second spring 70.

A ring member 3 rotatably received in the ring-shaped head 2 and supported on a flange 21 extending radially inward from the inner periphery of the head 2. The ring member 3 has a toothed outer periphery 31 and a serrated inner periphery 30 which is able to engage with a polygonal object such as a nut. A pawl 4 is movably received in the recess 22 and has a toothed surface 40 which has a number of teeth so as to match with the toothed outer periphery 31 of the ring member 3. Two curve surfaces 41, 42 are defined in two ends of the pawl 4 so as to respectively engage with the curve surface defining the recess 22 when the pawl 3 is moved. A protrusion 43 extends from a top of the pawl 4.

A plate 65 has a notch 650 within which the protrusion 43 is retained therein and two rods 63 extend from the plate 65. A C-shaped retainer 55 is received in a groove 23 defined in the inner periphery of the head 2 and a positioning ring 5 is engaged with the ring-shaped head 2 to push the pawl 4 in position. A slot 52 is defined through the positioning ring 5 and the two rods 63 extend through the slot 52. A lever 60 having a head 62 which has two holes so as to receive the two rods 63 of the plate 65. The lever 60 has two wings 61 each of which has a dent 610 so that the second ball 80 is engaged with one of the two dents 610.

Figure 4:
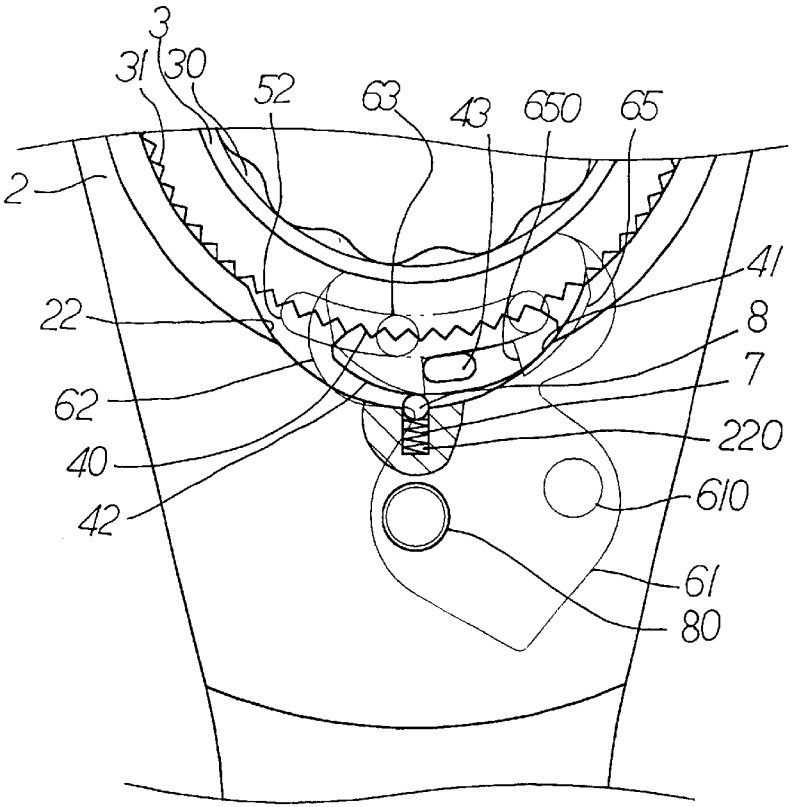
FIG. 4 is an illustrative view to show the lever is shifted counter clockwise to move the pawl to an extreme position.

When the lever 6 is shifted counter clockwise as shown in FIGS. 3 and 4, the plate 65 is moved and moves the pawl 4 because the protrusion 43 is pushed by a periphery of the notch 650. The second ball 80 is received in one of the two dents 610 to inform the user that the proper position of the pawl 4 is reached. When the pawl 4 is moved to an extreme position, the curve surface 41 is matched with the curve surface defining the recess 22 so as to provide strong backup. Because the number of the teeth of the toothed surface 40 is more than the conventional pawl so that the ratchet tool of the present invention can output a larger torque.

Figure 6:
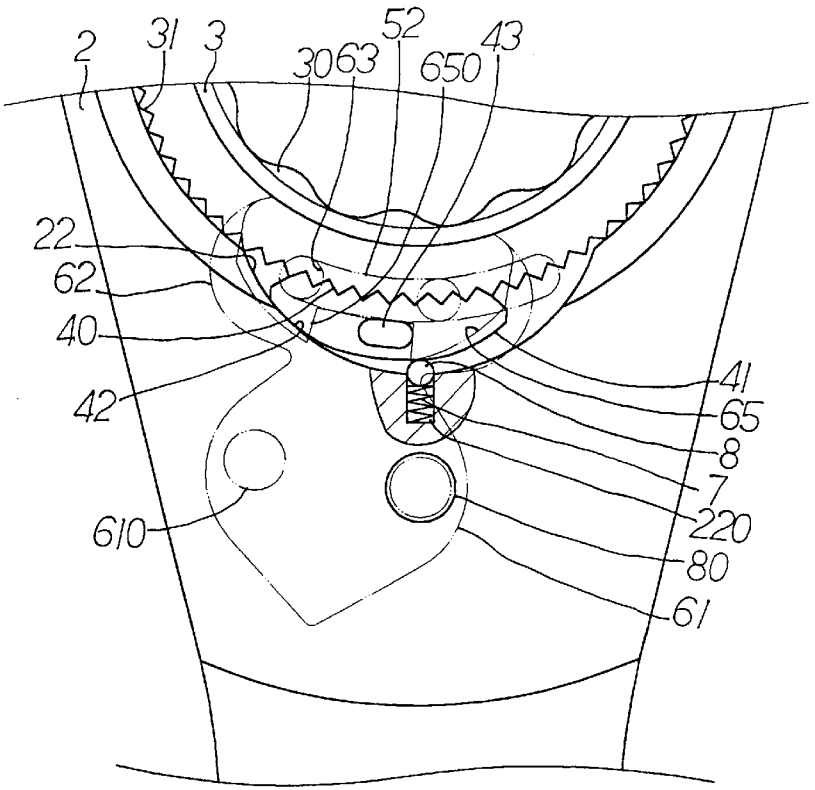
FIG. 6 is an illustrative view to show the lever is shifted clockwise to move the pawl to an extreme position.
Figure 5:
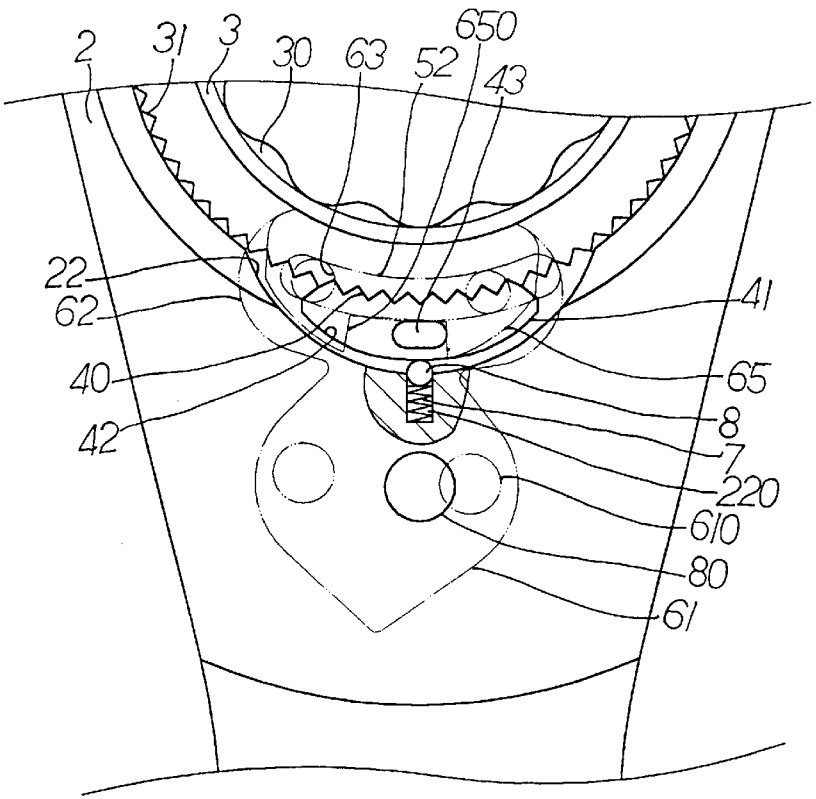
FIG. 5 is an illustrative view to show the lever is about to shifted clockwise.

FIGS. 5 and 6 shows that the lever 61 is shifted clockwise and the other curve surface 42 is matched with the curve surface defining the recess 22.

While we have shown and described various embodiments in accordance with the present invention, it should be clear to those skilled in the art that further embodiments may be made without departing from the scope and spirit of the present invention.

What is claimed is:

1. A ratchet tool comprising:

a ring-shaped head having a recess defined in an inner periphery thereof and a first passage defined in a curve surface defining said recess, a first ball and a first spring respectively received in said first passage, a second passage defined in a surface of said ring-shaped head, a second ball and a second spring received in said second passage;

a ring member rotatably received in said ring-shaped head and having a toothed outer periphery and a serrated inner periphery;

a pawl movably received in said recess and having a toothed surface, a protrusion extending from a top of said pawl;

a plate having a notch for retaining said protrusion therein and two rods extending therefrom;

a positioning ring engaged with said ring-shaped head and having a slot defined therethrough, said two rods extending through said slot, and a lever having a head which has two holes so as to receive said two rods of said plate, said lever having two wings and each wing having a dent so that said second ball is engaged with one of said two dents.

2. The ratchet tool as claimed in claim 1, wherein two curve surfaces are defined in two ends of said pawl so as to respectively engage with said curve surface defining said recess.

* * * * *